US007416054B2

(12) United States Patent
Liggett

(10) Patent No.: US 7,416,054 B2
(45) Date of Patent: Aug. 26, 2008

(54) CABLE HOOK TRACKING SYSTEM

(76) Inventor: James Liggett, 3450 Eagle Dr., Allegan, MI (US) 49010

( * ) Notice: Subject to any disclaimer, the term of this patent is extended or adjusted under 35 U.S.C. 154(b) by 635 days.

(21) Appl. No.: 10/972,267

(22) Filed: Oct. 25, 2004

(65) Prior Publication Data

US 2006/0090960 A1 May 4, 2006

(51) Int. Cl.
*A63G 31/00* (2006.01)

(52) U.S. Cl. ..... 182/36; 472/15; 472/136

(58) Field of Classification Search ..... 182/3, 182/10, 12, 13, 36, 38; 104/112, 116, 173.1; 211/113; 248/218.4, 298.1, 299.1; 434/247, 434/255; 472/15, 35; 273/440, 441, 449
See application file for complete search history.

(56) References Cited

U.S. PATENT DOCUMENTS

| | | | | |
|---|---|---|---|---|
| 291,014 | A * | 12/1883 | Isard | 182/12 |
| 2,699,199 | A * | 1/1955 | Huntington | 104/112 |
| 6,604,605 | B2 | 8/2003 | Peterson | |
| 6,640,727 | B2 * | 11/2003 | Ostrobrod | 104/91 |

* cited by examiner

*Primary Examiner*—Katherine Mitchell
*Assistant Examiner*—Colleen M. Quinn
(74) *Attorney, Agent, or Firm*—Robert J. Sayfie

(57) ABSTRACT

An apparatus and method of traversing across elements of a challenge course by use of a tracking system that can continuously retain the harness cable that descends to the participant, as the moveable member moves in a substantially horizontal direction along the safety cables, or along the tracks of the moveable member exchange frame.

4 Claims, 5 Drawing Sheets

CABLE HOOK TRACKING SYSTEM

FIELD OF THE INVENTION

The invention relates to a system to allow users of a challenge course to remain secured to a single safety hook when moving from one challenge element to another, or from one direction to another.

BACKGROUND OF THE INVENTION

Challenge courses are structures that allow a person, or a team to challenge themselves by participating in various events such as walking at elevated heights or climbing. These courses are also used to train military personnel. These courses are also used at recreational parks or other such centers that have go-carts and miniature gulf. It is common for people to wait in line to participate in the challenge course. Therefore increasing the speed of the flow of participants is an important feature of the challenge courses as well as increasing safety. The participants are usually performing some act at an elevated level between support structures. A harness cable secures the participant to a safety hook also called a moveable member. The safety hook or moveable member usually slides along cables substantially oriented horizontally as the participant walks on an "element" below, whereby the participant is secured to the moveable member or safety hook by a substantially vertically oriented harness cable. Therefore it is also an important feature to retain the harness cable to the moveable member without interruption.

Many problems with challenge courses center around the traffic flow and the detachment of the harness cable from the moveable member when the participant who is secured to the harness cable, is not secured to the moveable member, the participant can fall to the ground. When the participant walks along the element between the support structures, the participant is secured to the harness cable, which is in turn secured to the safety hook, which moves along the horizontally oriented safety cables. The cause of many of the flow problems are caused by factors such as releasing and re-attaching of the harness cable from the moveable member that takes place when the participant changes elements, usually at the support structure. For example, when the participant is completing one element, they stand on some fixed platform at the support structure. Here, the participant, if wishing to travel on another element, will remove the safety hook that is specific for that first element, and will attach a second hook, which is specific for the new element.

There exists a need to reduce the time to detach and re-attach the moveable members or safety hooks as the participants walk through the different elements.

Multiple embodiments of the system are disclosed herein. It will be understood that other objects and purposes of the invention, and variations thereof, will be apparent upon reading the following specification and inspecting the accompanying drawings.

BRIEF SUMMARY OF THE INVENTION

The present invention solves the problems of removing and re-attaching the moveable members or safety hooks. This increases flow speed and safety. Flow speed is increased because the participant's harness hook need not be released and re-attached. Safety is increased because the participant's harness hook remains attached to the moveable member continuously rather than intermittently.

Figure 1:
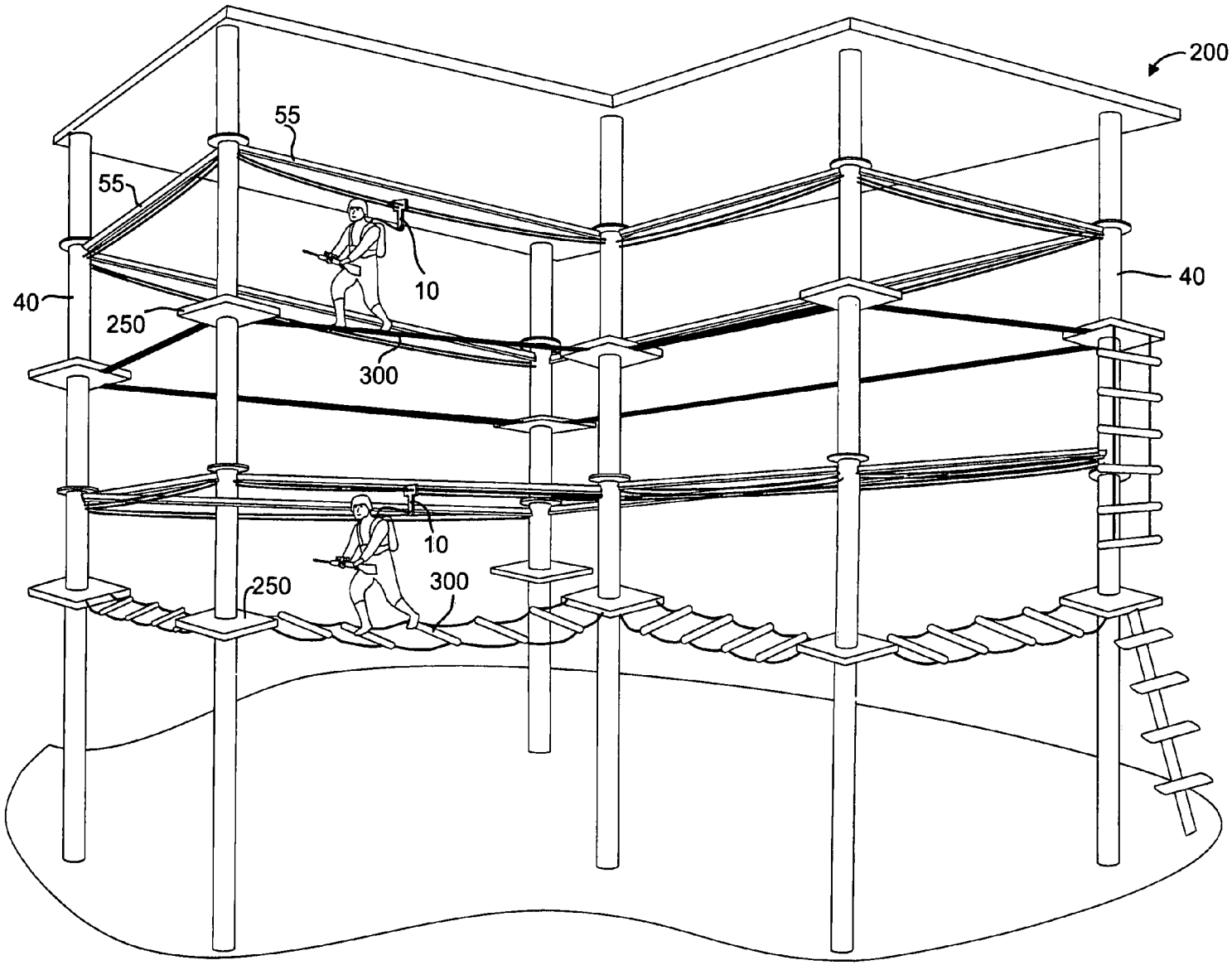
FIG. 1 is a pictorial view of a challenge course.
Figure 2:
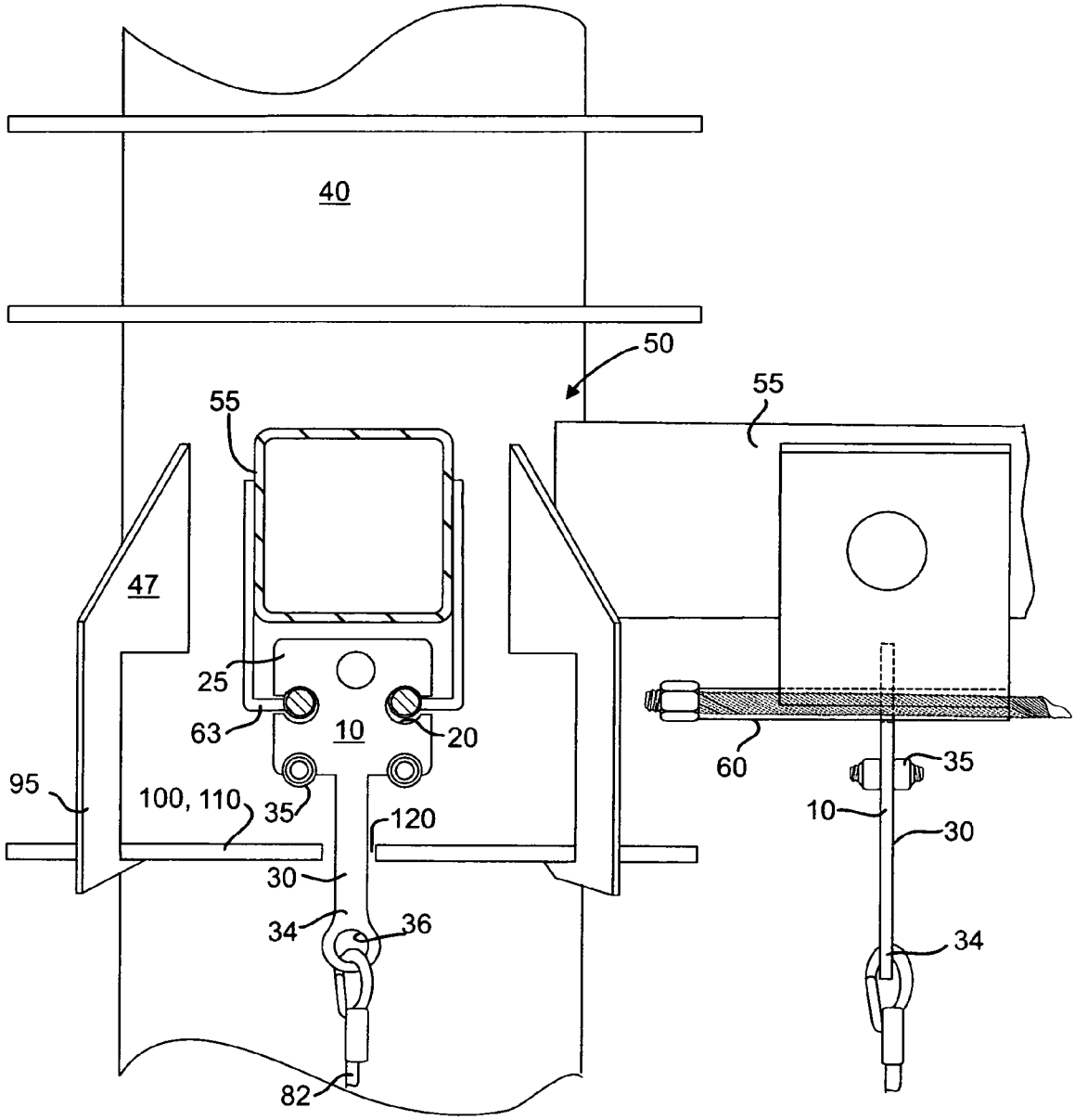
FIG. 2 is a pictorial view of the cable hook tracking system showing the moveable member on the tracks.
Figure 3:
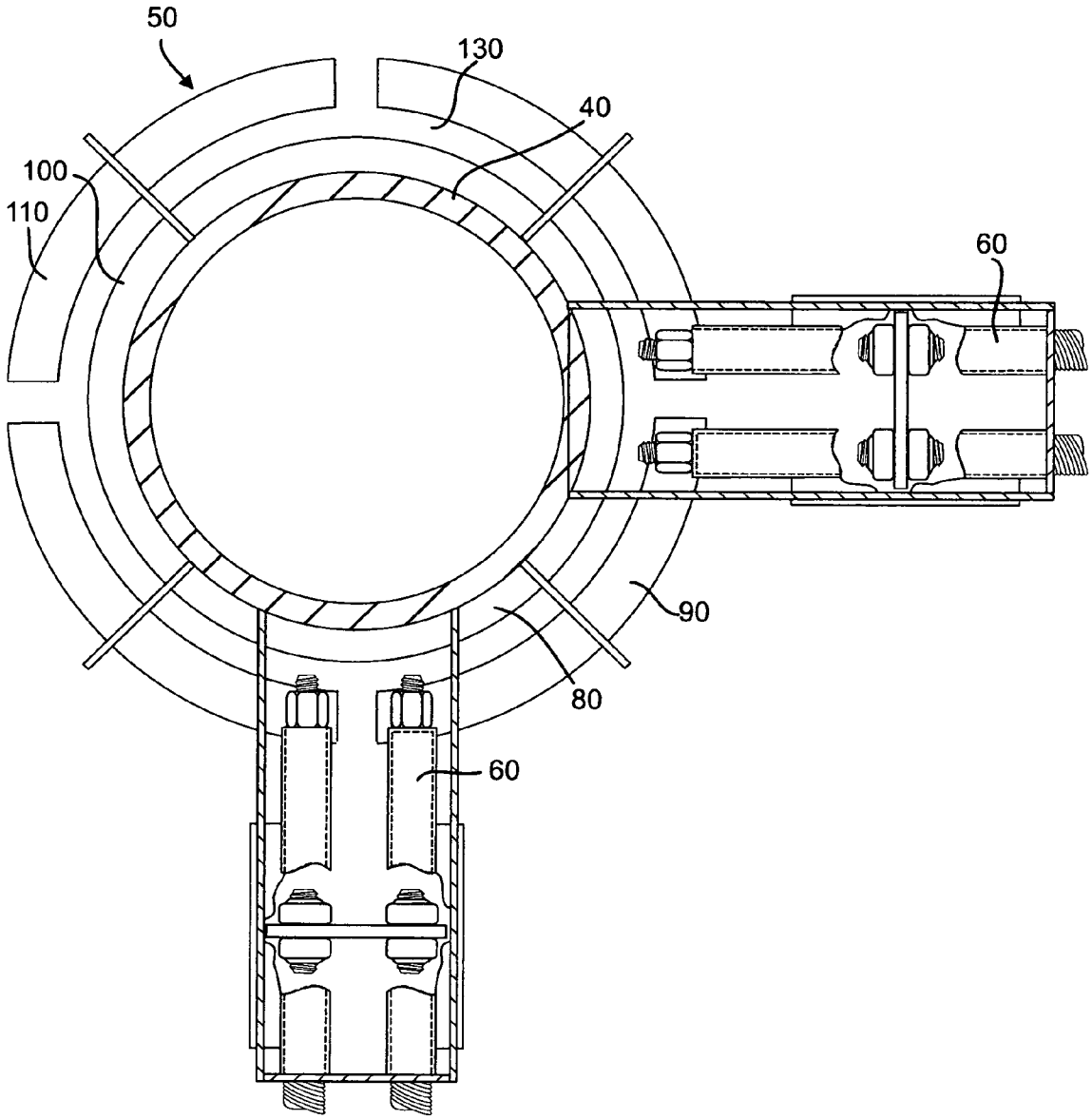
FIG. 3 is a pictorial view of the cable hook tracking system showing the moveable member sliding over the safety cable attachment members.
Figure 4:
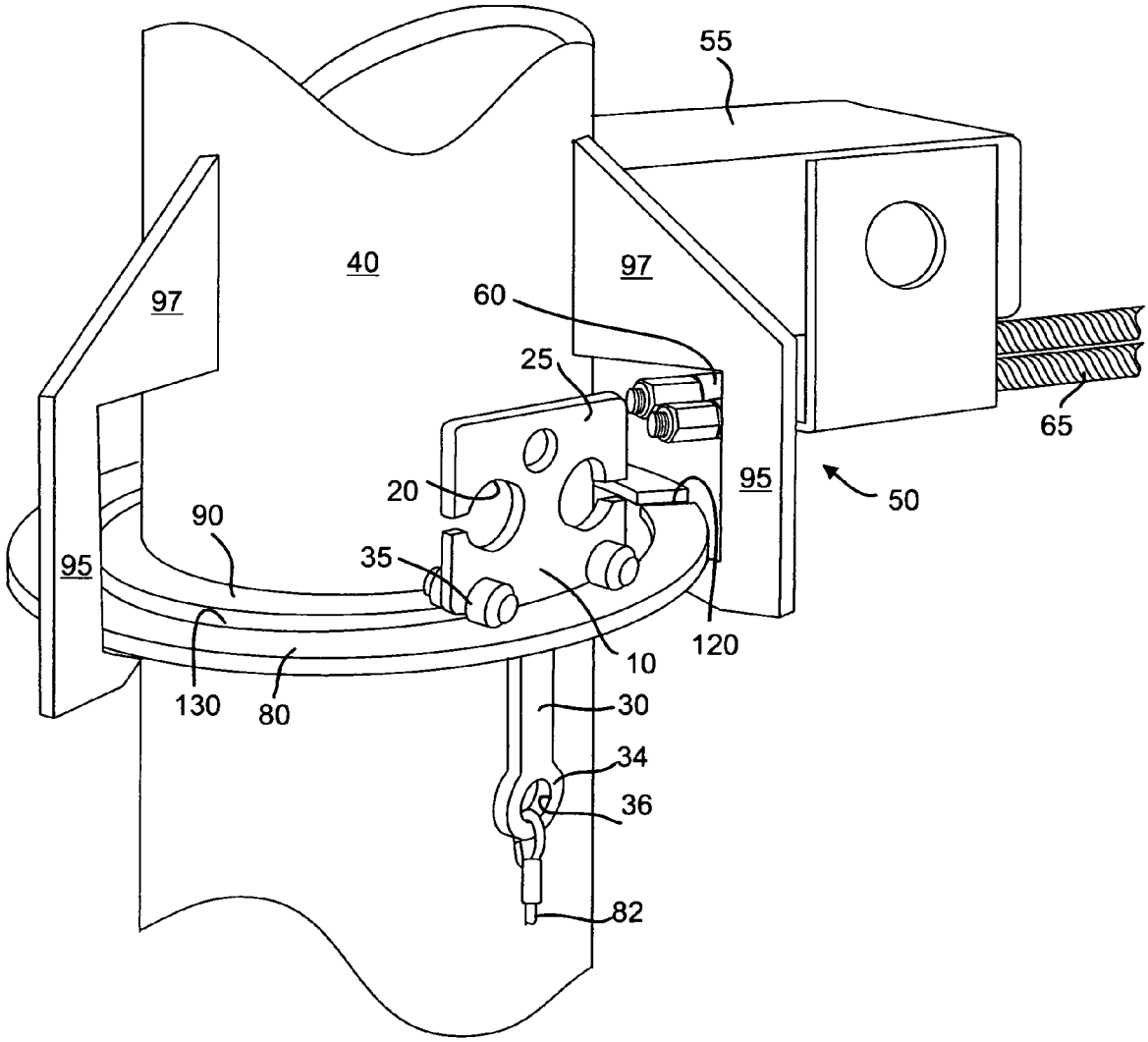
FIG. 4 is a pictorial view of the cable hook tracking system showing the moveable member moving along the safety cables.
Figure 5:
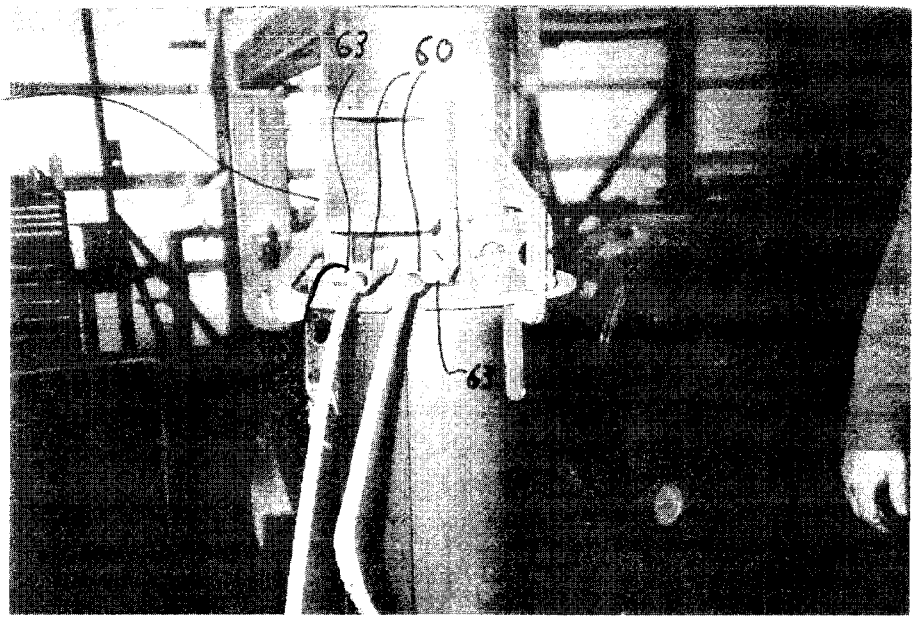
FIG. 5 is a pictorial view of the cable hook tracking system showing the safety cable attachment member.
Figure 6:
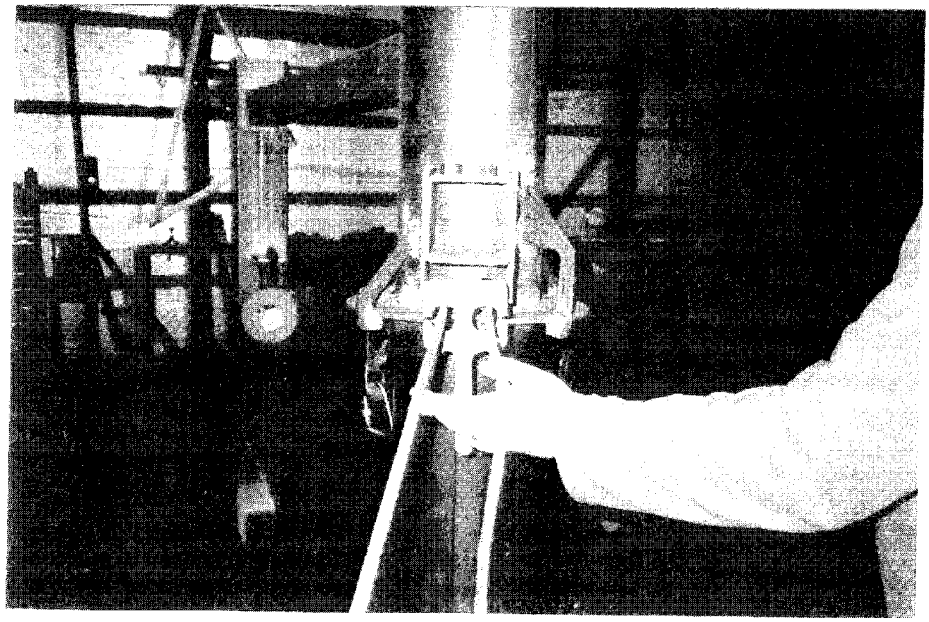
FIG. 6 is a pictorial view of the cable hook tracking system showing the moveable member and junction.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words.

DETAILED DESCRIPTION

Referring to FIG. 1, a challenge course (200) is illustrated. Also shown are support structures (40), elements (300) fixedly attached to and between said support structures (40). The cable hook tracking system enables the participant walking along one element (300) to reach a base (250) and then continue in a different direction (90 degrees is shown) onto a second element (300) without releasing any hooks.

The participant walks along a first element towards a support structure (40) and its accompanying moveable member junction (55), then the participant or other person moves the moveable member (10) over the safety cable attachment members (60) and ribs (63) via the aperture (20) within the moveable member (10). Then, the moveable member (10) is moved along tracks (80) (90) to a second moveable member junction (not shown). Then the participant walks along a second element (300).

The cable hook tracking system for a support structure comprises a moveable member (10) having an aperture (20) disposed in an upper rectangular portion (25) of said moveable member (10) and a harness cable attachment portion (30) that extends downward from said upper rectangular portion (25), said harness cable attachment portion (30) terminating in a lower portion (34) having a harness cable hole (36), said moveable member (10) further having a glide (35) that is disposed substantially between said aperture (20) and the lower portion (34) of the harness cable attachment portion (30). A moveable member exchange frame (50) is secured to the support structure (40), said moveable member exchange frame (50) having a moveable member junction (55). Said moveable member junction (55) extends substantially horizontally away from the support structure (40), said moveable member junction (55) having a safety cable attachment member (60) secured to a horizontally oriented rectangular shaped, plate-like rib (63) that is secured to said moveable member junction (55). Said moveable member exchange frame (50) having an inner track (90) adjacent to and secured to said support structure (40), said moveable member exchange frame (50) also having an outer track (80) fixed to an arm lower portion (95), said arm lower portion (95) extends upward and radially inward terminating in an arm upper portion (97) that is fixed to said support structure (40), each of said tracks (80), (90) having an upper surface (100), (110) that is substantially on the same plane as the other respective upper surface (110), (100), further, said outer track (80) is spaced concentric with and radially away from said inner track (90) so as to define a slot (130) between said inner track (90) and said outer track (80), further, said outer track (80) has a separation (120) adaptable to receive said lower portion (34) theretrough and into said slot (130). A safety cable (82) is removeably secured to said safety cable attachment member (60). Whereby said moveable member (10) can be moved from the safety cable (82) to the moveable member junction (55) past said rib (63) and past said safety cable attachment member (60) so said glide (35) moveably engages with both said inner track (90) and said outer track (80) so that said moveable member (10) can be moved along the tracks (80, 90) to a second moveable member junction (not shown).

The moveable member exchange frame (50) can be integral with the support structure (40), or it can be constructed on a separate housing jacket (not shown) that can be installed or removeably secured to a support structure (40). For example, if the support structure (40) is cylindrical, then the housing jacket can be made of two semi-circular portions that attach to one another as a clamp.

All of the components can be constructed of metal, such as steel. Alternatively, the components can be made of a rigid yet resilient composite.

The glide 35 can rotate along an axis, like a tire rotates around an axle. Alternatively it can slide along the tracks (80) (90) due to the low resistance factor between the glide (35) and the track (80), (90).

Although particular preferred embodiments of the invention have been discussed in detail for illustrative purposes, it will be recognized that variations or modifications of the disclosed apparatus, including the rearrangement of parts, lie within the scope of the present invention.

I claim:

1. A cable hook tracking system for a support structure comprising:

a moveable member (10) having an aperture (20) disposed in an upper rectangular portion (25) of said moveable member (10) and a harness cable attachment portion (30) that extends downward from said upper rectangular portion (25), said harness cable attachment portion (30) terminating in a lower portion (34) having a harness cable hole (36), said moveable member (10) further having a glide (35) that is disposed substantially between said aperture (20) and the lower portion (34) of the harness cable attachment portion (30);

a moveable member exchange frame (50) secured to the support structure (40), said moveable member exchange frame (50) having a moveable member junction (55)

said moveable member junction (55) extends substantially horizontally away from the support structure (40), said moveable member junction having a safety cable attachment member (60) secured to a horizontally oriented rectangular shaped, plate-like rib (63) that is secured to said moveable member junction (55);

said moveable member exchange frame (50) having an inner track (90) adjacent to and secured to said support structure (40), said moveable member exchange frame (50) also having an outer track (80) fixed to an arm lower portion (95), said arm lower portion (95) extends upward and radially inward terminating in an arm upper portion (97) that is fixed to said support structure (40), each of said tracks (80), (90) having an upper surface (100), (110) that is substantially on the same plane as the other respective upper surface (110), (100), further, said outer track (80) is spaced concentric with and radially away from said inner track (90) so as to define a slot (130) between said inner track (90) and said outer track (80), further, said outer track (80) has a separation (120) adaptable to receive said lower portion (34) theretrough and into said slot (130);

a safety cable (82) removeably secured to said safety cable attachment member (60); and whereby said moveable member (10) can be moved from the safety cable (82) to the moveable member junction (55) past said rib (63) and past said safety cable attachment member (60) so said glide (35) moveably engages with both said inner track (90) and said outer track (80) so that said moveable member (10) can be moved along the tracks (80, 90) to a second moveable member junction.

2. A cable hook tracking system for a support structure comprising:

a moveable member (10) having an aperture (20) disposed in an upper rectangular portion (25) of said moveable member (10) and a harness cable attachment portion (30) that extends downward from said upper rectangular portion (25), said harness cable attachment portion (30) terminating in a lower portion (34) having a harness cable hole (36), said moveable member (10) further having a glide (35) that is disposed substantially between said aperture (20) and the lower portion (34) of the harness cable attachment portion (30);

a moveable member exchange frame (50) integral with the support structure (40), said moveable member exchange frame (50) having a moveable member junction (55)

said moveable member junction (55) extends substantially horizontally away from the support structure (40), said moveable member junction having a safety cable attachment member (60) secured to a horizontally oriented rectangular shaped, plate-like rib (63) that is secured to said moveable member junction (55);

said moveable member exchange frame (50) having an inner track (90) adjacent to and secured to said support structure (40), said moveable member exchange frame (50) also having an outer track (80) fixed to an arm lower portion (95), said arm lower portion (95) extends upward and radially inward terminating in an arm upper portion (97) that is fixed to said support structure (40), each of said tracks (80), (90) having an upper surface (100), (110) that is substantially on the same plane as the other respective upper surface (110), (100), further, said outer track (80) is spaced concentric with and radially away from said inner track (90) so as to define a slot (130) between said inner track (90) and said outer track (80), further, said outer track (80) has a separation (120) adaptable to receive said lower portion (34) theretrough and into said slot (130);

a safety cable (82) removeably secured to said safety cable attachment member (60); and whereby said moveable member (10) can be moved from the safety cable (82) to the moveable member junction (55) past said rib (63) and past said safety cable attachment member (60) so said glide (35) moveably engages with both said inner track (90) and said outer track (80) so that said moveable member (10) can be moved along the tracks (80, 90) to a second moveable member junction (55').

3. The cable hook tracking system for a support structure of claim 1, further comprising:

said moveable member exchange frame being removeably secured to the support structure.

4. The cable hook tracking system for a support structure of claim 1, further comprising:

Said moveable member exchange frame being fixedly secured to said support structure.

* * * * *